United States Patent [19]

Kline

[11] Patent Number: 4,895,370

[45] Date of Patent: Jan. 23, 1990

[54] RANDOM NUMBER SELECTION DEVICE

[76] Inventor: Michael A. Kline, 3245 K Port Royale Dr., Fort Lauderdale, Fla. 33308

[21] Appl. No.: 297,408

[22] Filed: Jan. 17, 1989

[51] Int. Cl.[4] ..... A63F 9/00

[52] U.S. Cl. ..... 273/144 B

[58] Field of Search ..... 273/144 R, 144 A, 144 B

[56] References Cited

U.S. PATENT DOCUMENTS 3,095,655 7/1963 Berglund et al. ..... 273/144 B
4,323,240 4/1982 Stewart et al. ..... 273/114 A

FOREIGN PATENT DOCUMENTS 899630 6/1962 United Kingdom ..... 273/144 A

*Primary Examiner*—Anton O. Oechsle
*Attorney, Agent, or Firm*—Morton J. Rosenberg; David I. Klein

[57] ABSTRACT

A random number selection device (10) is provided with a support base (20) having a pair of extending substantially parallel arms (22) between which a hollow container (30) is rotatably mounted. Within container (30) there is provided a plurality of balls (15) each having indicia (17) representing a different numeric symbol to provide a random selection of digits. Coupled to container (30) there is provided, ball distributor (40) having a sliding actuator (42) with a plurality of partitions integrally formed thereon to define queuing spaces (50) therebetween. Ball receiving housing (46) having a plurality of integrally formed partitions (48), defining ball receiving chambers (45) is coupled to a tubular housing (44) of distributor (40). Sliding actuator (42) is biased in a first position by a spring (49), in this position partitions (43 and 48) cooperate to prevent balls (15A) located in queuing spaces (50), when container (30) is inverted, from entering the respective ball receiving chambers (45). Displacement of sliding actuator (42) to a second position, wherein partitions (43 and 48) are in alignment, permits the substantially simultaneous distribution of balls (15A) to the ball receiving chambers (45). The balls (15A) are captured within ball receiving chambers (45) subsequent to release of the sliding actuator (42) which is biased by spring (49) to its original position.

18 Claims, 3 Drawing Sheets

RANDOM NUMBER SELECTION DEVICE

BACKGROUND OF THE INVENTION

1. Field of the Invention

This invention directs itself to selection devices for choosing random numbers having a predetermined number of digits. In particular, this invention directs itself to a rotatably mounted container having a plurality of balls, each having indicia representing a different numeric symbol, contained therein. Still further, this invention directs itself to a random number selection device which substantially simultaneously distributes a predetermined number of randomly distributed balls to respective ball receiving chambers for viewing. More in particular, this invention pertains to random number selection devices wherein the simultaneously distributed balls are captured within the ball receiving chambers and maintained therein. Further, this invention directs itself to a random number selection device wherein the simultaneous distribution of balls carrying the numeric symbols is made responsive to rotation of the container to a substantially inverted position and sliding displacement of an actuator from a first position to a second position. Return of the actuator to the first position captures the distributed balls within respective receiving chambers until the container is rotated to a substantially upright position and the actuator again slidingly displaced from a first position to a second position, and thereby releasing the previously captured balls.

2. Prior Art

Random number selection devices are well known in the art. The best prior art known to the Applicant include U.S. Pat. Nos. 3,468,542; 4,616,831; 4,280,702; and, 4,699,382. Some prior art devices, such as that shown in U.S. Pat. Nos. 3,468,542; 4,616,831; and, 4,280,702 are directed to lottery number selection devices having a plurality of balls, each having numeric symbols inscribed thereon, for selection of a predetermined number of digits. However, such systems sequentially distribute the balls to a receiving housing, as opposed to the simultaneous distribution of all of the predetermined number of digits. And such systems do not provide secure capturing of the balls and thus an inadvertent tilting of the device can cause the balls to be returned to the hollow container from whence they came.

In other prior art systems such as U.S. Pat. No. 4,699,382, there are provided multi-digit selecting devices wherein balls are randomly selected by cessation of rotation of a hollow container with the ball receiving chambers located at the bottom of the container. While such systems may provide the substantially simultaneous distribution of the predetermined number of balls, such systems do not provide means for capturing the balls within the receiving chambers, nor do they provide simultaneous distribution responsive to the displacement of an actuator, as provided by the instant invention.

SUMMARY OF THE INVENTION

A random number selection device includes a support base having a pair of extending substantially parallel arms. This selection device further includes a hollow container rotatably mounted between the extending parallel arms and having at least one substantially planar surface through which there is formed an aperture.

Within the hollow container there is provided a plurality of balls each having indicia representing a different numeric symbol. The random number selection device also includes a ball dispenser coupled to the planar surface for receiving a portion of the plurality of balls through the aperture. The ball dispenser includes an actuator which operates to substantially simultaneously distribute a predetermined number of the portion of the plurality of balls to a corresponding number of ball receiving chambers, responsive to displacement of the actuator.

DESCRIPTION OF THE PREFERRED EMBODIMENTS

Referring now to FIGS. 1–8, there is shown random number selection device 10 for selecting a predetermined number of numeric digits from a predetermined quantity thereof. As will be seen in following paragraphs, random number selection device 10 is specifically directed to the concept of substantially simultaneously selecting a predetermined number of randomly mixed balls, each ball having a different numeric symbol inscribed thereon. Although not restricted to selection of lotto numbers, selection device 10 is particularly adapted for use by the public in selecting a multi-digit number for use in playing a lottery or lotto type game. Additionally, selection system 10 provides for a visually attractive system and allows the user to quickly select a predetermined number of random digits in a simultaneous, rather than sequential, fashion.

Figure 1:
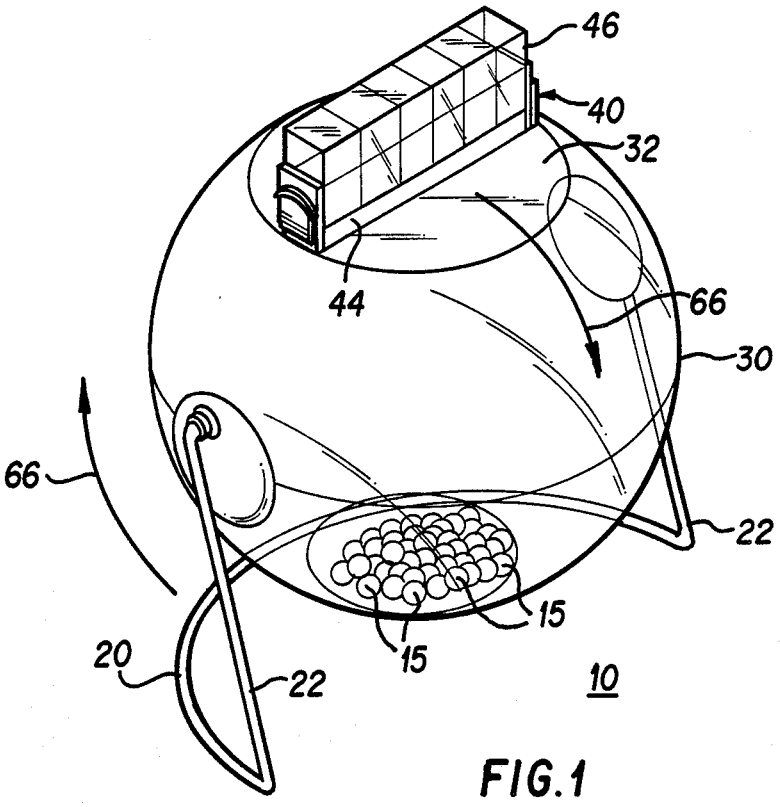
FIG. 1 is a perspective view of the selection device.

Random number selection device 10, as shown in FIG. 1, includes a support base 20 having a pair of extending substantially parallel arms 22. Rotatably mounted between the pair of arms 22 there is provided a hollow container 30, in which there is located a plurality of balls 15. Container 30 has an elongated aperture 31 formed therethrough and positionally located substantially orthogonal to the rotative axis for container 30.

Random number selection device 10 further includes ball distributor 40 coupled on one end to the hollow container 30 coaxial with the elongated aperture 31, and on the opposing end, ball distributor 40 is coupled to ball receiving housing 46. Ball distributor 40 receives a portion of the plurality of balls 15 through aperture 31 for substantially simultaneously distributing a predetermined number of balls, of that portion received, to ball receiving housing 46. Transfer of the predetermined number of balls to the ball receiving housing 46 is responsive to displacement of an actuator 42 from a first position to a second position.

Distributor 40, in addition to including the actuator 42, includes an actuator housing 44 having a tubular contour with a first open end coupled to container 30 and coaxial with aperture 31. An opposing second open end of housing 44 is coupled to the ball receiving housing 46 and thereby providing a passage for the balls to pass from aperture 31 into ball receiving housing 46. Actuator housing 44 is defined by a pair of opposing side walls and a pair of opposing end walls, with one of the end walls having a through opening formed therein through which the actuator 42 is slidingly displaceable.

In one working and illustrated embodiment, container 30 is provided with a planar surface 32 located substantially orthogonal to the rotative axis for container 30 and through which is formed the elongated aperture 31. Distributor 40 is coupled to planar surface 32 such that actuator housing 44 is coaxial the elongated aperture. Although, container 30 is shown as having a truncated spherical configuration, it should be understood that other configurations are possible without departing from the spirit or scope of the inventive concept.

Referring now to FIGS. 1–4, the structure and operation of random number selection device 10 will be further described. As container 30 is rotated, as indicated by direction arrows 66, the balls 15 are mixed before passing through elongated aperture 31 as container 30 is rotated to a substantially inverted position. In this position, the balls 15 randomly enter actuator housing 44. The sliding actuator member 42 is formed with a plurality of partitions 43 between which defines a queuing space 50 for each of the predetermined number of digits to be selected by device 10. Thus, the balls 15 pass through aperture 31 providing a random distribution of the balls 15A and 15B located within the queuing space 50 defined by the partitions 43 of the sliding actuator member 42. Actuator 42 is biased in a first position by a biasing element or spring 49 positioned between an end wall of housing 44 and an adjacent end of the actuator 42. Ball receiving housing 46 includes a predetermined number of partitions 48, between which define a predetermined number of ball receiving chambers corresponding to the number of digits to be selected by device 10. Each of ball receiving chambers 45 are dimensioned for receipt of a single ball 15, such that when sliding actuator member 42 is displaced from its biased position to a second position, a single ball drops into each of the predetermined number of ball receiving chambers 45.

Figure 2:
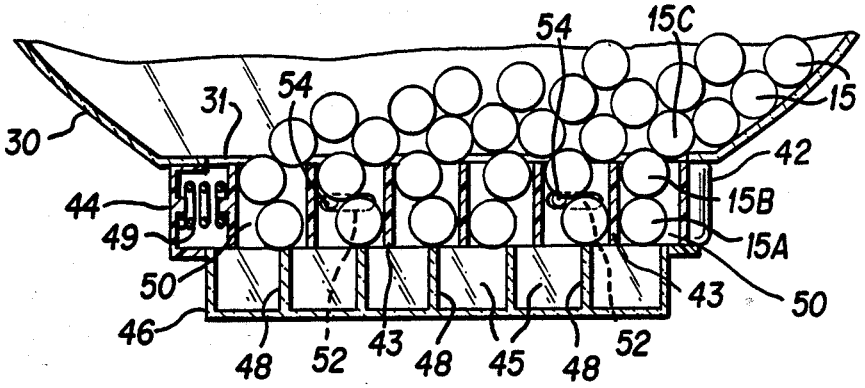
FIG. 2 is a cut-away plane view of a portion of the selection device showing the actuator in one operative position.
Figure 3:
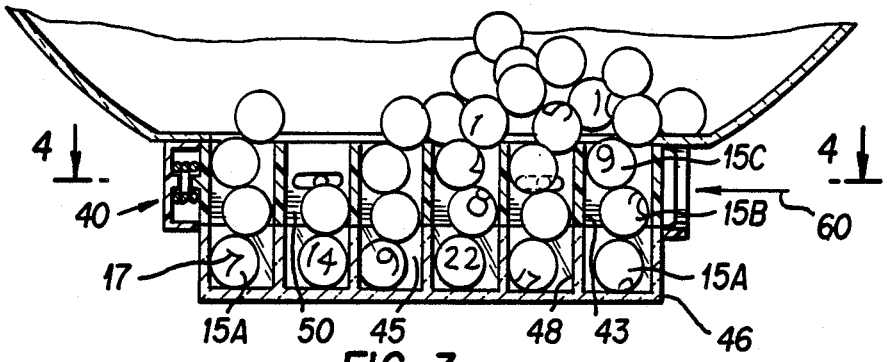
FIG. 3 is a cut-away plane view of the selection device showing the actuator in a second operative position.

Actuator partitions 43 and ball receiving chamber partitions 48 cooperate to control the transfer of balls 15A from the queuing space 50 to the ball receiving chambers 45, as shown in FIGS. 2 and 3. When actuator 42 is in its normal position, biased by spring 49, the actuator partitions 43 are not in alignment with the ball receiving partitions 48, and therefore the queuing spaces 50 are not in alignment with the ball receiving chambers 45. The misalignment has been predetermined to prohibit the passage of a ball 15A into the ball receiving chamber 45. When it is desired to randomly select the digits, the sliding actuator 42 is displaced to a second position, in a direction indicated by directional arrow 60, compressing the bias spring 49 and aligning the partitions 43 and 48, thereby aligning the queuing spaces 50 with respective ball receiving chambers 45. Alignment of queuing spaces 50 with respective ball receiving chambers 45 allows the predetermined number, corresponding to the number of queuing spaces 50 and respective ball receiving chambers 45, of balls 15A to pass from the queuing space 50 to the respective ball receiving chambers 45. The remaining balls 15B in queuing spaces 50 positionally replace the balls 15A and balls 15C enter queuing spaces 50, however, the balls 15B or 15C do not enter the ball receiving space 45, since it is dimensioned for receipt of only a single ball.

Subsequent to the balls 15A entering the ball receiving chambers 45, the sliding actuator member 42 is released, allowing the spring 49 to return sliding member 42 to its first position, displacing the ball queuing spaces relative to the ball receiving chambers 45, thereby capturing the balls 15A therein.

Figure 5:
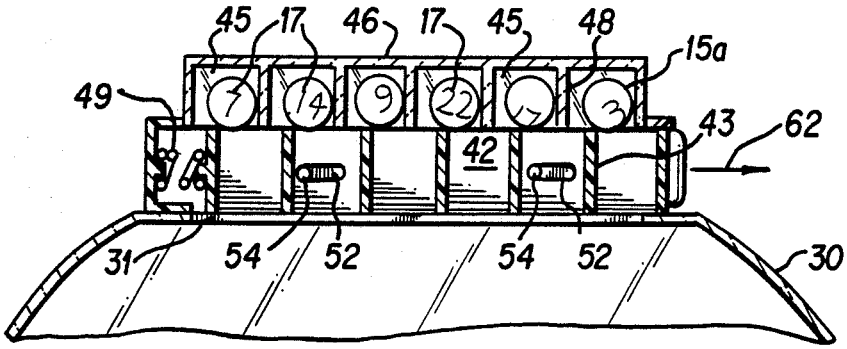
FIG. 5 is a cut-away plane view of the selection device showing the balls captured within the ball receiving chambers.
Figure 6:
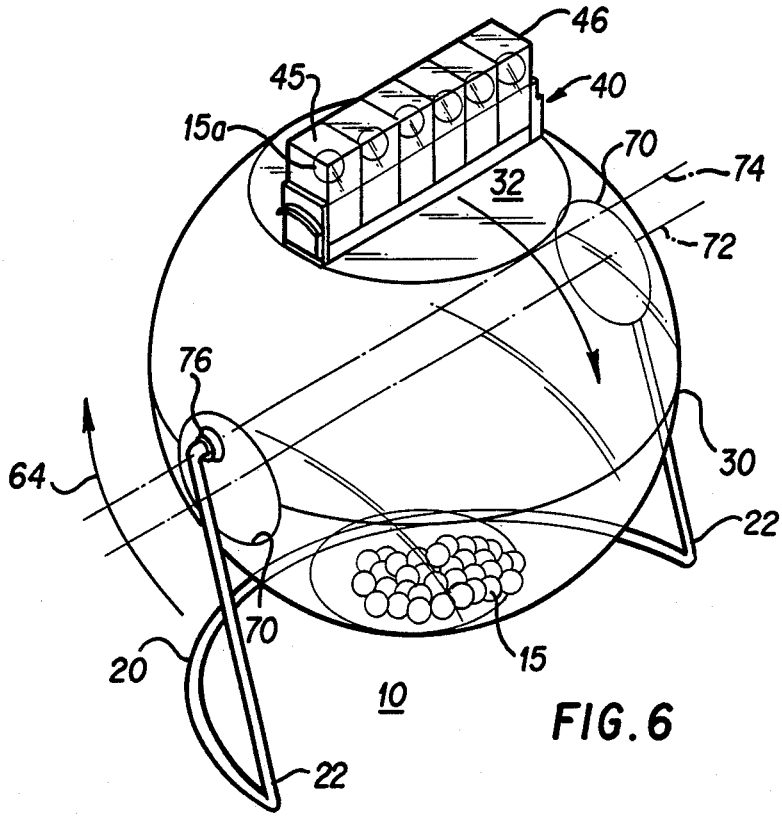
FIG. 6 is another perspective view of the selection device.

The container 30 may then be rotated as indicated by direction arrow 64, shown in FIG. 6, to return container 30 to a substantially upright position. In this position, the balls 15B and 15C drop from the queuing spaces 50 while the balls 15A remain captured within the ball receiving spaces 45, shown in FIG. 5. The partitions 43 and 48 being out of alignment, prevent the balls 15A from passing back into container 30. Ball receiving housing 46 being formed of a transparent plastic material composition, allows the individual numeric symbols 17 to be discerned. These randomly selected digits can then be utilized for playing a lottery or lotto type game.

The balls 15A can be returned to the container 30 by simply displacing the sliding actuator member 42, as was previously done to simultaneously distribute the balls 15A, allowing the ball receiving chambers 45 to align with the queuing spaces 50, and thereby permitting the balls to fall back into container 30 when container 30 is in a substantially upright position.

Figure 4:
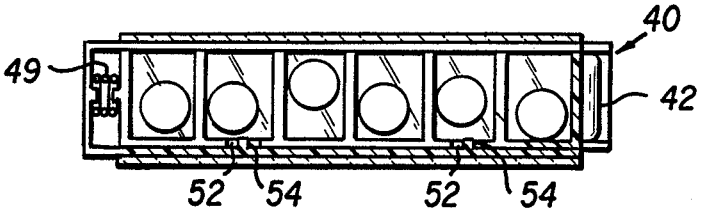
FIG. 4 is a sectional view of the actuator taken along the section line 4—4 of FIG. 3.

Referring now to FIGS. 2 and 4, there is shown the means by which the sliding actuator 42 is maintained within actuator housing 44. A side wall of the tubular housing 44 is provided with a pair of pins 54, each passing through a slotted through opening 52 formed in the sliding actuator 42. This arrangement allows sliding member 42 to be slidingly displaced between its two operable positions while preventing displacement in an orthogonal direction. Sliding actuator 42 with its integrally formed partitions 43 is maintained between the pair of opposing side walls of actuator housing 44 with sufficient clearance to allow sliding displacement thereof.

Figure 7:
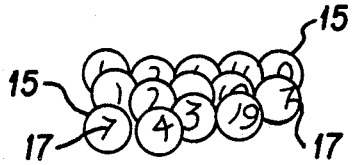
FIG. 7 is a perspective view of the balls with the numeric symbols.
Figure 8:
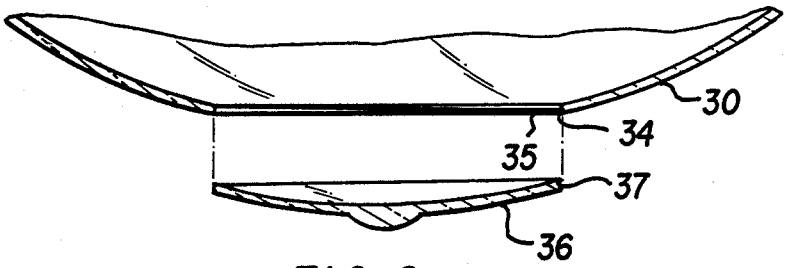
FIG. 8 is a cut-away plane view of a portion of the selection device showing an access opening and cover therefor.

Because the lotto games of different localities utilize different digit ranges, container 30 is provided with an access opening 34, shown in FIG. 8, through which the correct number of balls 15 having the appropriate range of numeric symbols 17 can be installed therein. Subsequent to insertion of the balls 15, shown in FIG. 7, into container 30, the access opening 34 is sealed by a closure or cap 36. The coupling of cap 36 to access opening 34 may be provided by threads 35 being formed in the perimeter wall of access opening 34 with cooperating threads being formed on the perimeter of cap 36, or by other means well known in the art.

Container 30 is mounted to the support arms 22 of support base 20 by means of a pair of mounting plates 70 located on opposing sides of container 30. Mounting plates 70 are coupled to container 30 on a central axis 72, orthogonal to the direction of rotation as indicated by directional arrow 64. Each mounting plate 70 is provided with a pivotal coupling 76 displaced from central axis 72 and defining an offset axis 74. Each arm 22 being pivotedly coupled to a respective coupling 76, thus provides a rotational axis 74 offset from the central axis 72 of container 30, to create an eccentric rotation about the offset axis 74. This eccentric rotation of container 30 causes a non-uniform displacement of the balls 15 as container 30 is rotated and thereby provides a better mixing of the balls, to provide the random numeric digits. Additionally, the offset rotational axis 74 for container 30 provides two desired stable positions for container 30.

The upright position of container 30, as shown in FIG. 6, is one of the two stable positions for container 30. Since a greater mass is suspended below the pivotal axis 74, container 34 normally maintains itself in this position. The second stable position is when container 30 is inverted with ball distributor 40 being positioned downwardly. The mass of ball distributor 40 and the balls 15 counterbalancing the mass at the opposing end. The planar surface 32 providing an over center type operation for achieving this second stable position, the balls rolling on the interior planar surface providing a sudden change in mass and thereby providing a sudden change from an unbalanced state to a balanced stable state as container 30 is rotated. Positions intermediate these two stable positions are unbalanced positions which cause the container 30 to rotate back to the first stable state with ball distributor 40 being positioned upright.

Referring back to FIGS. 1–5, random number selection device 10 is shown comprising a support face 20 having a pair of extending substantially parallel arms 22, with a hollow container 30 rotatably mounted between arms 22. Within container 30, there is provided a plurality of balls 15, each having indicia representing a different numeric symbol 17 inscribed thereon. The random digits are selected by capturing a predetermined number of balls 15 within a ball receiving housing 46 subsequent to being dispensed from actuator housing 44. The means for dispensing balls 15 to the predetermined number of ball receiving chambers 45 formed in ball receiving housing 46 is provided by an actuator 42 slidably coupled within actuator housing 44 and having a predetermined number of partitions 43, between which defines queuing spaces 50.

Each of the predetermined number of ball receiving chambers 45 is defined by a predetermined number of partitions 48 integrally formed in ball receiving housing 46. Ball receiving housing partitions cooperate with actuator member partitions 43 to simultaneously dispense a single ball to each of ball receiving chambers 45 and maintain them therein until subsequent displacement of actuator 42 releases them therefrom.

Rotation of the container 30 to an inverted position, with ball distributor 40 in a downward orientation allows balls 15A, 15B and 15C to be sequentially arranged in each of the queuing spaces 50. The queuing spaces 50 being offset from the ball receiving chambers 45 by the actuator 42 being biased at a first position by the spring 49. The randomly arranged balls 15A may be distributed to respective ball receiving chambers 45, substantially simultaneously, by slidingly displacing actuator 42 against the spring bias, in a direction indicated by directional arrow 60, and thereby aligning the queuing spaces 50 with respective ball receiving space chambers 45.

The ball receiving chambers 45 are dimensioned to hold only a single ball 15A and thus the balls 15B and 15C remain within respective queuing spaces 50. When the actuator 42 is released, allowing the spring 49 to return actuator 42 to its previous position, the queuing spaces 50 are displaced out of alignment with respective ball receiving chambers 45. The predetermined misalignment between the ball receiving chamber partitions 48 and the actuator partitions 43, which previously prevented the balls 15A from entering ball receiving chambers 45, now prevent the balls 15A from exiting chambers 45, thereby capturing balls 15A therein.

Rotation of container 30 back to an upright position, as shown in FIGS. 5 and 6, causes the balls 15B and 15C to drop from the queuing spaces 50 while the balls 15A remain captured within the ball receiving housing 46. Ball receiving housing 46 being formed by a transparent material facilitates the display of the indicia 17 representing the randomly selected digits, which then may be used for playing a lottery or lotto type game. From this upright position, the balls captured within the ball receiving housing 46 may be returned to chamber 30 by again slidingly displacing actuator 42 against the spring bias to realign the queuing spaces 50 with the ball receiving chambers 45, and thereby permitting the balls 15A to pass back through the elongated aperture 31 into container 30.

To add versatility to random number selection device 10 for accomodating the differences in lottery and lotto type games of various localities, container 30 is provided with an access opening 34, shown in FIG. 8, through which the desired number of balls 15, shown in FIG. 7, having the desired range of numeric symbols 17 can be inserted. The balls are maintained within container 30 by closure of access opening 34 with a cap 36 adapted for releasable coupling with container 30. Such adaptations may be in the form of cooperating threads 35 and 37, or other means well known in the art. To further add versatility to selection device 10, it is contemplated that ball distributor 40 be releasably coupled to container 30 to allow the interchangeability of a plurality of ball distributors 40, each having a different predetermined number of ball receiving chambers 45.

Ball distributor 40 may be releasably coupled to container 30 by several convenient means. The perimeter of elongated aperture 31 may be encompassed by a hook and loop type fastener element adhesively bonded thereto. Similarly, a cooperating hook and loop type fastener element may be bonded to the mating perimeter edge of each distributor 40 to provide interchangeable coupling therewith. Alternately, elongated aperture 31 may be encompassed by a raised flange for slidable coupling with each distributor 40 having a cooperating aperture and grooves formed in the interior surface of the walls of actuator housing 44. In this way, the user can make use of a ball distributor 40 having six ball receiving chambers 45 to select a lotto number and then interchange that distributor 40 with one having four ball receiving chambers to select a four-digit lottery number after adjusting the quantity of balls 15.

In still another alternate embodiment for selection device 10, access opening 34 may be closed by planar surface 32 having distributor 40 fixedly coupled thereto. In this manner, planar surface 32 may be threadedly coupled to access opening 34 providing means to adjust the number of balls 15 and the range of numeric symbols, as well as providing a convenient means for interchanging one distributor 40 with another, each coupled to a planar surface 32.

As a further improvement over prior art devices, random number selection device 10 provides means to eccentrically rotate container 30 by means of a pair of mounting plates 70 coupled to container 30 on opposing sides of a central axis 72 and each having a pivotal connection 76 coupled to a respective extending arm 22 of support base 20. Pivotal connection 76 defines an assymetrical offset axis 74 for eccentric rotation of container 30. This arrangement provides two stable states or positions for container 30, a substantially upright position with distributor 40 facing an upward direction, and a substantially inverted position with distributor 40 facing substantially downward.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A random number selection device, comprising:

a support base having a pair of extending substantially parallel arms;

a hollow container rotatably mounted between said arms and having at least one substantially planar surface, said planar surface having an aperture formed therethrough, said hollow container being eccentrically rotatably coupled between said arms;

a plurality of balls each having indicia representing a different numeric symbol inscribed thereon, said balls being located within said hollow container; and, dispensing means coupled to said planar surface for receiving a portion of said plurality of balls through said aperture, said dispensing means including actuator means for substantially simultaneously distributing a predetermined number of said portion of said plurality of balls to a corresponding number of ball receiving chambers responsive to displacement of said actuator means.

2. The random number selection device as recited in claim 1 where said dispensing means includes a tubular body member having a first open end coupled to said planar surface coaxial said aperture, said tubular body member being defined by a pair of opposing side walls and a pair of opposing end walls, one of said pair of end walls having an opening formed therethrough, said actuator means being slidingly displaceable through said opening.

3. The random number selection device as recited in claim 2 where said actuator means includes a slide member having a predetermined number of partitions integrally formed thereon, said partitions being spaced one from the other to define a predetermined number of ball queuing spaces therebetween.

4. The random number selection device as recited in claim 3 where said actuator means further includes a biasing element for biasing said slide member to a first position wherein said partitions prevent passage of said balls between said ball queuing spaces and said ball receiving chambers.

5. The random number selection device as recited in claim 4 where said ball receiving chambers are coupled to a second open end of said tubular body member.

6. The random number selection device as recited in claim 5 where each of said ball receiving chambers are of predetermined size for receipt of a single one of said balls responsive to both displacement of said slide member to a second position and said hollow container being rotated to a substantially inverted position.

7. The random number selection device as recited in claim 6 where subsequent to said displacement of said slide member to said second position said biasing element returns said slide member to said first position for capturing said balls within said ball receiving chambers.

8. The random number selection device as recited in claim 7 where said captured balls are released from said ball receiving chambers by displacement of said slide member to said second position coincident with said hollow container being rotated to a substantially upright position.

9. The random number selection device as recited in claim 1 where said hollow container has an access opening formed therein, said recess opening having a perimeter wall adapted for releasable coupling with a closure member.

10. A random number selection device, comprising:

a support base having a pair of extending substantially parallel arms;

a plurality of balls each having indicia representing numeric symbols;

container means rotatably coupled between said arms for displacing said plurality of balls contained therein, said container means includes a hollow enclosure having an elongated aperture formed therethrough, said container means further including mounting means coupled to said hollow enclosure on a first axis and pivotedly coupled to said support base arms on a second axis for eccentric rotation of said hollow enclosure about said second axis;

ball receiving means for capturing a predetermined number of said plurality of balls from said hollow enclosure; and, dispensing means coupled on one end to said hollow enclosure and on the opposing end to said ball receiving means for receiving a portion of said plurality of balls through said elongated aperture of said hollow enclosure and substantially simultaneously distributing said predetermined number of said balls to said ball receiving means.

11. The random number selection device as recited in claim 10 where said dispensing means includes a tubular body member having a first open end coupled to said hollow enclosure coaxial said aperture, said tubular body member being defined by a pair of opposing side walls and a pair of opposing end walls, one of said pair of end walls having an opening formed therethrough.

12. The random number selection device as recited in claim 11 where said dispensing means further includes actuator means slidingly coupled to said tubular body member for said substantially simultaneous distribution of said predetermined number of said balls responsive to displacement of said actuator means.

13. The random number selection device as recited in claim 12 where said actuator means includes a slide member having a predetermined number of partitions integrally formed thereon, said partitions, being spaced one from the other to define a predetermined number of ball queuing spaces therebetween for receipt of said predetermined number of balls through said aperture.

14. The random number selection device as recited in claim 13 where said actuator means further includes a biasing element for biasing said slide member to a first position wherein said partitions prevent passage of said balls between said ball queuing spaces and said ball receiving means.

15. The random number selection device as recited in claim 14 where said ball receiving means includes a transparent enclosure coupled to a second open end of said tubular body member, said transparent enclosure having a predetermined number of integrally formed partitions for defining a predetermined number of discrete ball receiving spaces, each of said ball receiving spaces being dimensioned for receipt of a single one of said balls.

16. The random number selection device as recited in claim 15 where said partitions of said transparent enclosure cooperate with said partitions of said slide member to prevent passage of said balls between said queuing spaces and said ball receiving spaces when said slide member is at said first position.

17. The random number selection device as recited in claim 16 where said balls are transferred from said queuing spaces to said ball receiving spaces responsive to both displacement of said slide member to a second position and said hollow enclosure being rotated to a substantially inverted position, said balls being captured within said ball receiving spaces responsive to a subsequent return of said slide member to said first position.

18. The random number selection device as recited in claim 17 where said balls are returned to said hollow enclosure from said ball receiving spaces by displacement of said slide member to said second position coincident with said hollow container being rotated to a substantially upright position.

* * * * *